US009719407B2

(12) United States Patent
Schwartz et al.

(10) Patent No.: US 9,719,407 B2
(45) Date of Patent: Aug. 1, 2017

(54) METHOD FOR REGULATING ENGINE TEMPERATURE

(75) Inventors: William Samuel Schwartz, Pleasant Ridge, MI (US); Brian D. Rutkowski, Ypsilanti, MI (US); Yonghua Li, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 559 days.

(21) Appl. No.: 13/566,593

(22) Filed: Aug. 3, 2012

(65) Prior Publication Data

US 2014/0034741 A1 Feb. 6, 2014

(51) Int. Cl.

| | |
|---|---|
| ***F16K 35/06*** | (2006.01) |
| ***G05D 23/02*** | (2006.01) |
| ***G05D 23/19*** | (2006.01) |
| ***F01P 7/16*** | (2006.01) |

(52) U.S. Cl.

CPC ..... *F01P 7/167* (2013.01); *F01P 2025/33* (2013.01)

(58) Field of Classification Search

CPC ..... E03C 1/041; G05D 23/022; G05D 23/08; F23N 3/047; F01P 7/16

USPC ..... 236/99 K, 99 J, 101 R, 103, 34.5; 123/41.08, 41.09, 41.1

See application file for complete search history.

(56) References Cited

U.S. PATENT DOCUMENTS

| | | | | |
|---|---|---|---|---|
| 5,529,025 | A * | 6/1996 | Ranzinger et al. | 123/41.1 |
| 5,758,607 | A | 6/1998 | Brendel et al. | |
| 6,857,576 | B2 | 2/2005 | Peter | |
| 7,171,927 | B2 | 2/2007 | Sano | |
| 7,320,434 | B2 | 1/2008 | Suda et al. | |
| 7,615,725 | B2 * | 11/2009 | Kosaka et al. | 219/483 |
| 2004/0041035 | A1 * | 3/2004 | Takei et al. | 236/34.5 |
| 2006/0162676 | A1 * | 7/2006 | Pegg | F01P 7/164 123/41.1 |

FOREIGN PATENT DOCUMENTS

| | | | |
|---|---|---|---|
| DE | 3018682 | A1 * | 11/1980 |
| JP | H06342251 | A * | 12/1994 |

OTHER PUBLICATIONS

Atsutaka, Controller for Heater and Load, Dec. 13, 1994, JPH06342254A, Whole Document.*

* cited by examiner

*Primary Examiner* — Justin Jonaitis
*Assistant Examiner* — Larry Furdge
(74) *Attorney, Agent, or Firm* — Julia Voutyras; McCoy Russell LLP

(57) ABSTRACT

A method for operating a device at a desired temperature is described. In one example, current supplied to a heater that melts a wax medium or material controlling flow through a valve is adjusted to reduce valve opening and closing delay. The method may improve device temperature control, thereby reducing device emissions, enhancing device performance, and improving device durability.

20 Claims, 4 Drawing Sheets

METHOD FOR REGULATING ENGINE TEMPERATURE

BACKGROUND/SUMMARY

Temperature of a device may be regulated by a thermostat that controls flow of coolant from the device to a radiator or heat exchanger. Some example devices may include but are not limited to a fuel cell, engine, battery, motor, inverter, compressor, turbine, and amplifier. The thermostat is mechanically held closed when device temperature is less than a threshold temperature. The thermostat begins to open after device temperature is greater than the threshold temperature. Thermostat opening and closing is controlled via melting and solidification of wax material within the thermostat. Such systems may be sufficiently reliable; however, they may not regulate device temperature as tightly as is desired.

Another type of device temperature control system is described in U.S. Pat. No. 6,857,576 and it supplies heat to a wax material in a valve based on a temperature difference between an engine (e.g., the device) and a radiator. This system may improve engine temperature control as compared to a system that relies solely on melting of a wax material via engine coolant, but it also requires two temperature sensors and it may not respond as rapidly as is desired. Consequently, engine temperature control may not be as accurate as is desired.

The inventors herein have recognized the above-mentioned limitations and have developed a method for adjusting device temperature, comprising: adjusting an amount of electrical current supplied to a heater, the heater in thermal communication with a wax material in a valve, the amount of electrical current adjusted to one of two states, the amount of electrical current adjusted in response to a sign of a derivative of an output of a sole temperature sensor.

By adjusting heater current responsive to a derivative of device temperature, it may be possible to provide an accurate and fast response to changes in device temperature. In one example, heater current may switch between substantially zero current (e.g., less than 300 mA) and substantially rated heater current (e.g., within 500 mA of rated heater current) to control engine temperature. For example, when engine temperature is increasing and greater than a desired temperature, heater current can be rapidly increased to heat a wax medium that controls coolant flow through a valve. The heat causes the wax medium to change state and allows coolant to flow through the radiator from the engine, thereby providing cooling to the engine. Similarly, when engine temperature is decreasing and less than a desired temperature, heater current can be rapidly decreased to allow a wax medium that controls coolant flow through a valve to cool. The reduction in heat causes the wax medium to change state and limits coolant to flow through the radiator from the engine, thereby reducing cooling to the engine. In this way, a bang-bang controller that adjusts heater current to regulate coolant flow from an engine through a radiator may be provided to rapidly and accurately control engine temperature.

The present description may provide several advantages. In particular, the approach may improve engine temperature control. Further, the approach may reduce engine emissions, improve performance, and increase durability by more accurately controlling engine temperature. Additionally, the approach may provide improved temperature control while only relying on a single engine temperature sensor, if desired.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
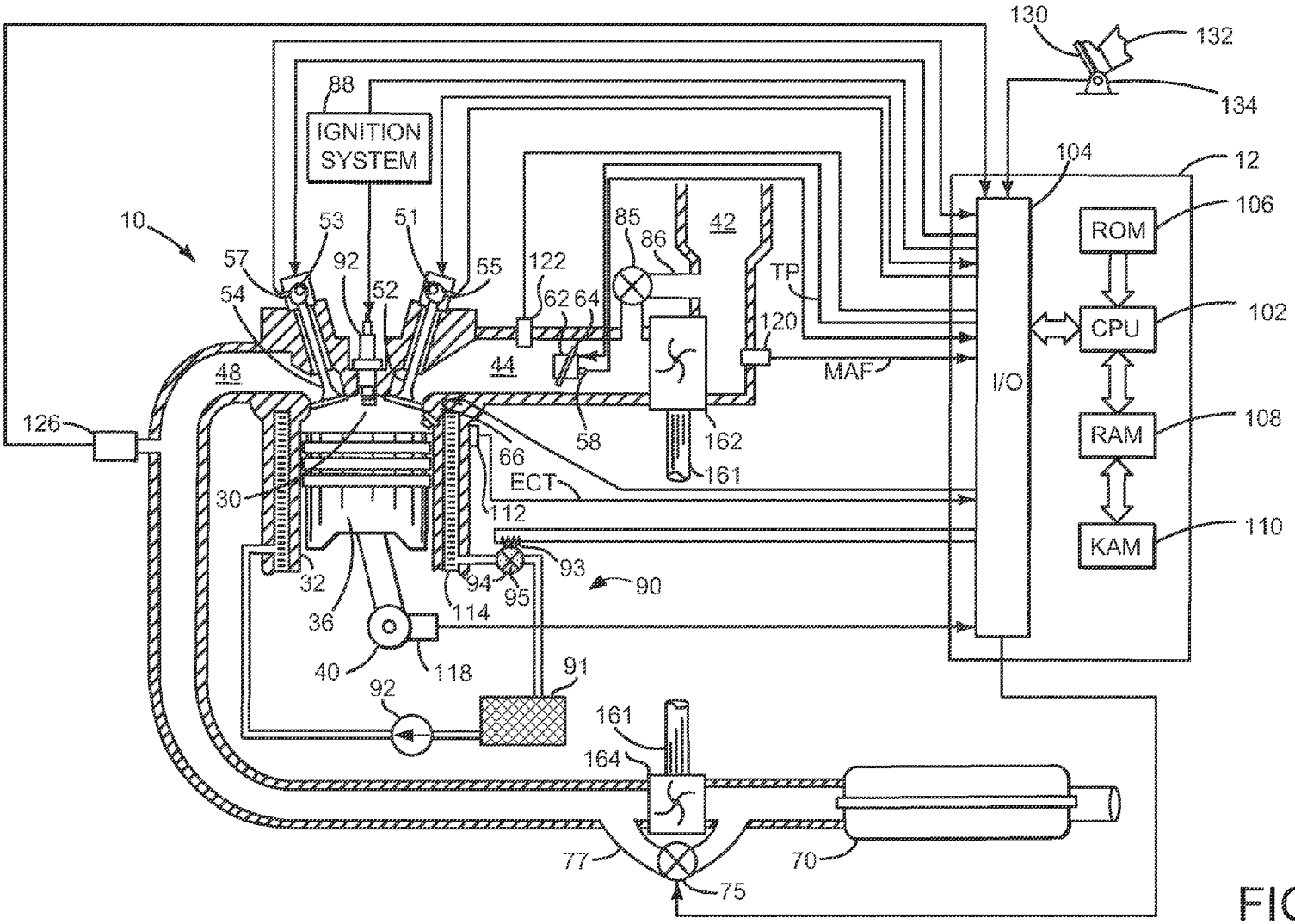
FIG. 1 shows a schematic depiction of an engine.
Figure 2:
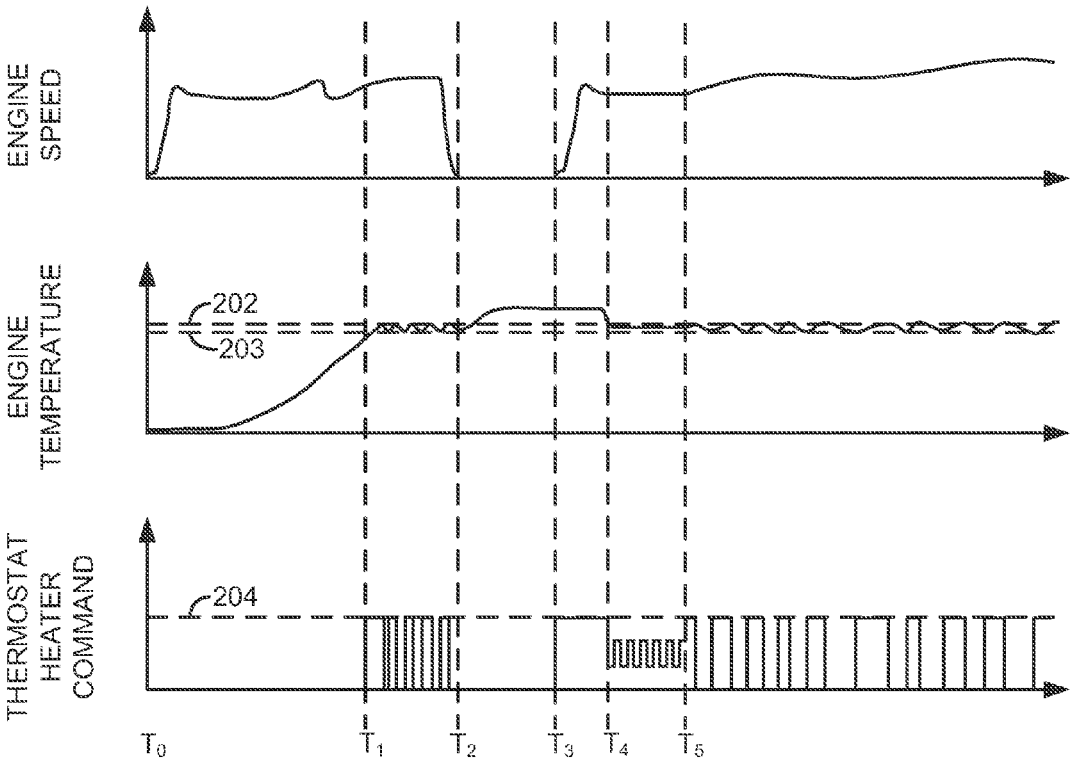
FIG. 2 shows an example engine operating sequence according to the method of FIG. 4.
Figure 3:
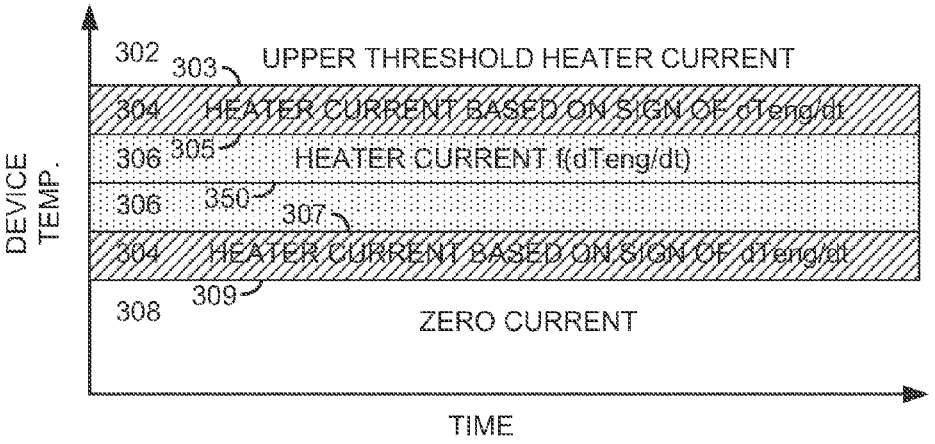
FIG. 3 shows an example device temperature control range and sub-range.
Figure 4:
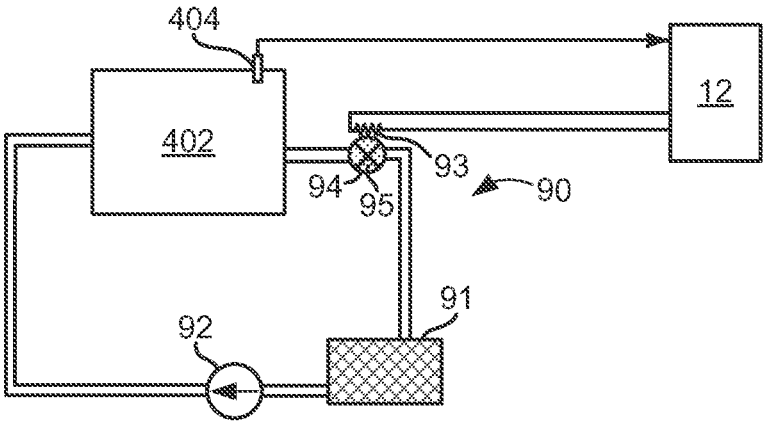
FIG. 4 shows an alternative device temperature control system.

The present description is related to controlling a temperature of a device. In one example described herein the device is an engine as shown in FIG. 1. In the engine example, current supplied to a heater that changes a state of a wax medium in an engine coolant control valve is adjusted between a lower current limit and an upper current limit. The lower and upper current limits may be determined based on engine operating conditions. FIG. 1 shows an example system that may be controlled as shown in the sequence of FIG. 2 according to the method of FIG. 5. In one example, device temperature control ranges as shown in FIG. 3 provide a basis for adjusting current supplied to the heater. FIG. 4 shows an alternative system where the device is a fuel cell, battery, motor, inverter, compressor, turbine, or amplifier, etc.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to a pulse width provided by controller 12. Fuel is delivered to fuel injector 66 by a fuel system (not shown) including a fuel tank, fuel pump, and fuel rail (not shown).

Intake manifold 44 is supplied air by compressor 162. Exhaust gases rotate turbine 164 which is coupled to shaft 161, thereby driving compressor 162. In some examples, a bypass passage 77 is included so that exhaust gases may bypass turbine 164 during selected operating conditions. Flow through bypass passage 77 is regulated via waste gate 75. Further, a compressor bypass passage 86 may be provided in some examples to limit pressure provided by compressor 162. Flow through bypass passage 86 is regulated via valve 85. In addition, intake manifold 44 is shown communicating with central throttle 62 which adjusts a position of throttle plate 64 to control air flow from engine air intake 42. Central throttle 62 may be electrically operated.

Distributorless ignition system 88 provides an ignition spark to combustion chamber 30 for igniting an air-fuel mixture via spark plug 92 in response to controller 12. In other examples, the engine may be a compression ignition engine without an ignition system, such as a diesel engine. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Engine temperature is controlled via coolant circuit 90. Coolant circuit 90 includes radiator or heat exchanger 91 which extracts excess heat from engine coolant. Additionally, coolant circuit 90 includes a coolant pump 92 and coolant control valve 94. Wax medium 95 allows or limits coolant flowing to/from radiator 91 to engine 10 depending on the state of wax medium 95. In one example, coolant flow through coolant control valve 94 is limited when wax medium 95 is less than a threshold temperature. Coolant flow through coolant control valve or thermostat 94 is allowed when wax medium 95 is greater than a threshold temperature. Thermostat heater 93 is in thermal communication with wax medium 95 and can supply heat to change the state of wax medium 95, thereby permitting or restricting coolant flow through coolant valve 94.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114 or alternatively a cylinder head; a position sensor 134 coupled to an accelerator pedal 130 for sensing accelerator position adjusted by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. Controller 12 also selectively provides current to thermostat heater 93. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. The hybrid vehicle may have a parallel configuration, series configuration, or variation or combinations thereof. Further, in some embodiments, other engine configurations or components which are not engines may be employed, for example a diesel engine, a fuel cell, a battery, a motor, an inverter, a compressor, etc. In these other examples, the aforementioned engine descriptions may not be applicable, but similar constructs can be envisioned by those skilled in the art.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples.

Referring now to FIG. 2, an engine operating sequence in which engine temperature is controlled is shown. The operating sequence of FIG. 2 may be provided via the system of FIG. 1 executing instructions stored in non-transitory memory of the method of FIG. 4. Vertical markers at times $T_0$-$T_5$ represent times of interest during the sequence.

The first plot from the top of FIG. 2 represents engine speed versus time. The X axis represents time and time increases from the left side of the plot to the right side of the plot. The Y axis represents engine speed and engine speed increases in the direction of the Y axis arrow.

The second plot from the top of FIG. 2 represents engine temperature versus time. The X axis represents time and time increases from the left side of the plot to the right side of the plot. The Y axis represents engine temperature and engine temperature increases in the direction of the Y axis arrow. Horizontal lines 202 and 203 represent bounds of an example desired engine temperature range. The desired temperature range is between horizontal lines 202 and 203.

The third plot from the top of FIG. 2 represents a thermostat heater command versus time. The X axis represents time and time increases from the left side of the plot to the right side of the plot. The Y axis represents a thermostat heater command where current supplied to the thermostat heater increases in the direction of the Y axis arrow as the thermostat heater command increases. Horizontal line 204 represents a thermostat upper threshold heater command that corresponds to an upper threshold heater current.

At time $T_0$, the engine is stopped and engine temperature is low. The thermostat heater command is also low or zero. When the thermostat heater command is low, substantially no current is supplied to the thermostat heater which allows a wax medium in the thermostat valve to stay in or go to a state where coolant flow is not allowed from the engine to the radiator.

Between time $T_0$ and time $T_1$, the engine is started in response to a driver request to start. Engine speed increases in response to starting the engine. The heater command and the engine temperature are low at the time of engine starting, but the engine temperature increases as the engine continues to operate for a longer period of time. A derivative of engine temperature is taken as engine temperature increases. The derivative has a positive sign indicating increasing engine temperature. The thermostat heater command remains at a low level while engine temperature is outside of the temperature range indicated by horizontal markers 202 and 203.

At time $T_1$, engine temperature reaches lower engine threshold temperature 203 and continues to rise. Consequently, in response to engine temperature above lower engine threshold temperature 203 and an engine temperature derivative with a positive sign, the thermostat heater command increases from substantially zero to a level 204 where the wax media changes state after being heated above a threshold temperature. In one example, the current is increased to a rated current of the thermostat heater.

Between time $T_1$ and time $T_2$, the thermostat heater command and current is driven between substantially zero and a predetermined value 204. The predetermined value may be adjusted for engine operating conditions. In some examples, the predetermined value is a rated heater current. Further, the heater current is driven between substantially zero and the predetermined value 204 based on a sign of a derivative of engine temperature. In particular, when the sign of the engine temperature derivative is positive, the thermostat heater current is increased to the predetermined level 204 from the substantially zero level. When the sign of the engine temperature derivative is negative, the thermostat heater current is decreased to substantially zero from the predetermined level 204. Driving heater current between substantially zero and the predetermined level 204 provides for a quick response when engine temperature begins to increase or decrease. Thus, engine temperature may be controlled within a narrow range to improve engine temperature control.

At time $T_2$, the engine is stopped and the thermostat heater command is reduced to zero so that substantially no current flows to the thermostat heater. The engine temperature is shown increasing in response to the engine being shut off. The engine temperature increases since heat is not driven out of the engine while the engine is not operating. The engine temperature increases to a level greater than the upper engine threshold temperature 202.

At time $T_3$, the engine is restarted in response to an engine start request from a driver. Engine temperature remains above upper engine threshold temperature 202. Current supplied to the thermostat heater is increased after the engine start request to threshold level 204 in response to engine temperature being greater than threshold temperature 202.

At time $T_4$, engine temperature falls below upper engine threshold temperature 202 and reaches a steady value between upper engine threshold temperature 202 and lower engine threshold temperature 203. The thermostat heater command is adjusted between two predetermined levels between the zero level and the predetermined level 203. Engine speed remains relatively constant at idle speed.

At time $T_5$, engine temperature increases toward upper engine temperature threshold 202 and the thermostat heater command and current are increased to predetermined level 204 to allow additional coolant to flow from the engine to the radiator. Further, engine speed increases in response to an operator torque command. The change in engine speed and output increases engine heat output; however, the change is counter acted via adjusting the thermostat heater command in response to a sign of a derivative of engine temperature. The thermostat heater command and current are driven between substantially zero and predetermined value 204 so that engine temperature stays between upper engine temperature threshold 202 and lower engine temperature threshold 203 for the remaining time shown in the sequence.

Referring now to FIG. 3, an example device temperature range versus time is shown. The X axis represents time and time increases from the left side of FIG. 3 to the right side of FIG. 3. The Y axis represents device temperature and device temperature increases in the direction of the Y axis arrow. Several different device temperature ranges are shown.

Line 303 represents an upper device threshold temperature defining an upper boundary of a desired device temperature range that extends from line 303 down to line 309. Area 302 is above line 303 and it represents a desired temperature zone where thermostat heater current is adjusted to an upper threshold current (e.g., rated heater current). Line 305 represents an upper sub-range desired threshold temperature defining an upper boundary of a desired temperature sub-range. Line 350 represents a desired device temperature. Line 307 represents a lower sub-range device threshold temperature defining a lower boundary of the device temperature sub-range. Line 309 represents a lower device threshold temperature defining a lower boundary of a desired device temperature range.

An upper threshold heater current may be applied to a thermostat heater when device temperature is in area 302 above upper engine threshold temperature 303. A heater current based on a sign of a derivative of device temperature may be applied to the thermostat heater when device temperature is in areas 304 which are above and below device temperature sub-ranges 306. Area 308, below lower device threshold temperature 309, is an area where substantially no current may be applied to the thermostat heater so that device temperature can increase toward desired device temperature 350.

Thus, in one example, a device temperature range that includes a sub-range device temperature range may provide a basis for adjusting a thermostat heater command and current. The thermostat heater command and current may be controlled differently when device temperature is within different areas of the device temperature range. In this way, response and accuracy of device temperature control may be improved.

Referring now to FIG. 4, an alternative example system for controlling device temperature is shown. Components or elements in FIG. 4 that have the same numerical tags as components in FIG. 1 are the same devices and operate in the similar manner as described in FIG. 1. Device 402 may be comprised of a fuel cell, battery, motor, inverter, compressor, turbine, or amplifier. And, temperature of device 402 may be controlled according to the method of FIG. 5 and similarly to as is described in FIG. 2. Device 402 is supplied coolant via pump 92. Coolant flow to or from device 402 may be limited by coolant control valve 94 which includes wax medium 95. Thermostat heater 93 supplies heat to change the state of wax medium 95. Electrical current selectively flows from controller 12 to thermostat heater 93 depending on inputs to controller 12 and executable instructions within controller 12. Coolant flows through device 402 and radiator or heat exchanger 91 when coolant control valve is in an open state. A sole temperature sensor 404 is a basis for supplying current to thermostat heater 93, and it supplies an output to controller 12 that corresponds to a temperature of device 402. Although temperature sensor 404 is shown as being located in device 402, it may be located elsewhere, such as in the coolant lines either entering or exiting device 402, or it may be located in such a way that the temperature of device 402 is inferred by controller 12 based on output from sensor 404.

Figure 5:
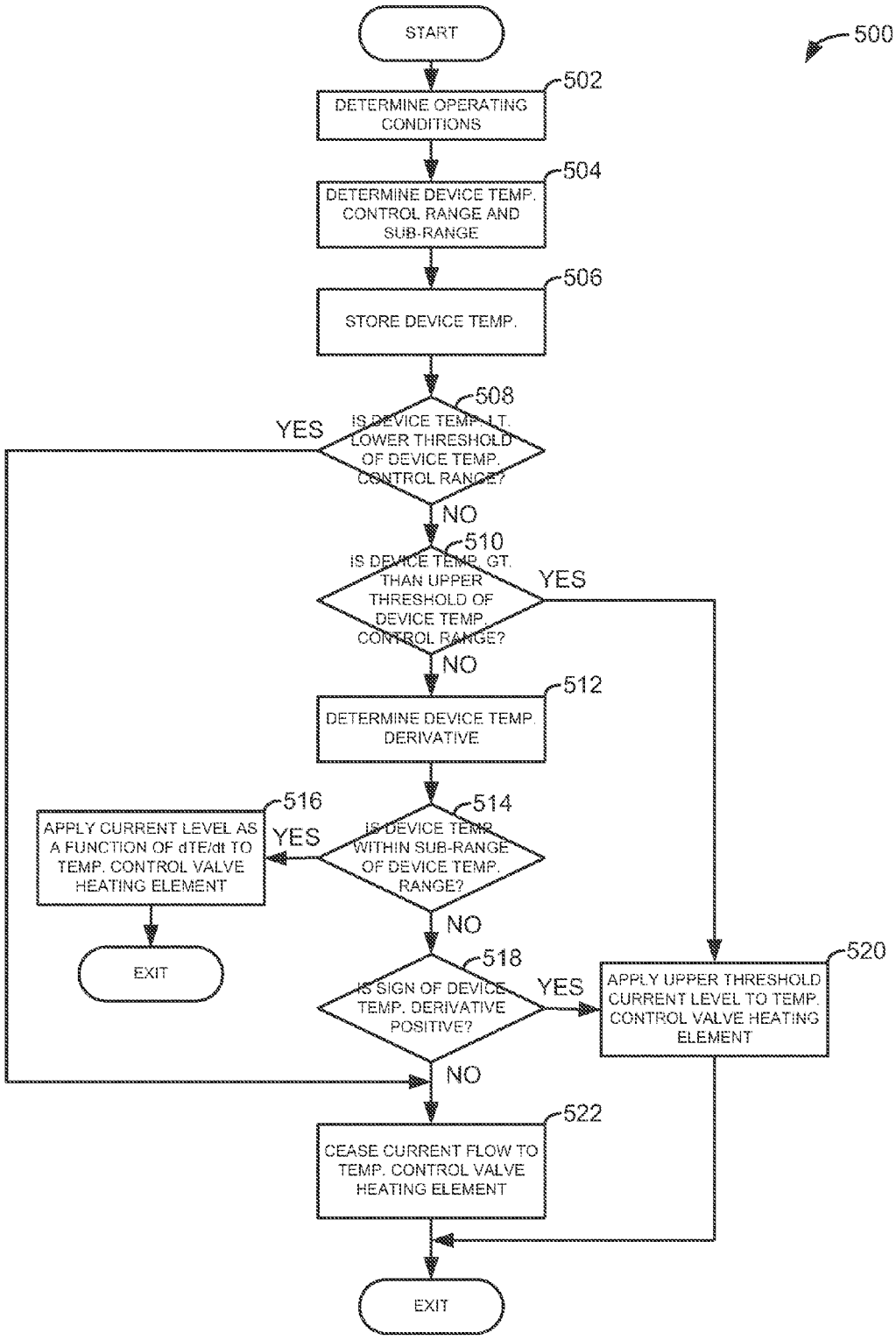
FIG. 5 shows an example method for controlling device temperature.

Referring now to FIG. 5, an example method for controlling or regulating device temperature is shown. The method of FIG. 5 may be stored as executable instructions in non-transitory memory of controller 12. Further, the method of FIG. 5 may provide the operating sequence shown in FIG. 2.

At 502, method 500 determines device operating conditions. Device operating conditions may include but are not limited to engine speed, engine load, amount of time since the engine was last stopped, engine temperature from within the engine, motor current, motor voltage, and desired engine torque level. Method 500 proceeds to 504 after device operating conditions are determined.

At 504, method 500 determines a device temperature control range and sub-range (e.g., see FIG. 3) in response to device operating conditions. In one example, engine speed and load are inputs to tables or functions that included empirically determined desired engine operating temperature ranges. For example, an upper engine threshold temperature and lower engine threshold temperature may be determined via indexing a table or function based on engine speed and load. Similarly, an engine sub-range temperature may be determined from upper and lower sub-range engine threshold temperatures that are retrieved from tables and/or functions using engine speed and load. In other examples, only a single device temperature range without a sub-range may be provided. In still other examples, the device temperature control range may simply be a single desired device temperature. Method 500 proceeds to 506 after the device temperature range is determined.

At 506, method 500 stores device temperature to memory for subsequently determining a derivative of device temperature from the present device temperature and past device temperature. Method 500 proceeds to 508 after device temperature is stored to memory.

At 508, method 500 judges whether or not device temperature is less than a lower threshold of a device temperature control range. For example, method 500 judges whether or not engine temperature is less than a temperature represented by line 309 of FIG. 3. If so, the answer is yes and method 500 proceeds to 522. Otherwise, the answer is no and method 500 proceeds to 510.

At 510, method 500 judges whether or not device temperature is greater than an upper threshold of a device temperature control range. For example, method 500 judges whether or not engine temperature is greater than a temperature represented by line 303 of FIG. 3. If so, the answer is yes and method 500 proceeds to 520. Otherwise, the answer is no and method 500 proceeds to 512.

At 512, method 500 determines a derivative of device temperature. In one example, the derivative is approximated via subtracting a device temperature sampled in the past from a present device temperature and dividing by the amount of time between the two device temperature samples. Additionally, in some examples derivatives of engine load, engine speed, or other device parameters may be determined at 512 in a similar manner as the device temperature derivative. Method 500 proceeds to 514 after derivatives are determined.

At 514, method 500 judges whether or not device temperature is within a sub-range (e.g., between 305 and 307 as shown in FIG. 3) of a desire device temperature control range. If so, the answer is yes and method 500 proceeds to 516. Otherwise, the answer is no, and method 500 proceeds to 518.

At 516, method 500 adjusts a current level applied to the thermostat heater as a function of the derivative of device temperature. The current adjustment may be proportional to the device temperature derivative. Further, the current adjustment may be increased or decreased depending on device operating conditions.

In other examples, a current level applied to a thermostat heater may be adjusted between a lower sub-level and an upper sub-level (e.g., thermostat heater command between time $T_4$ and $T_5$ in FIG. 2) that lie between the substantially zero current supplied at 522 and the upper threshold current level supplied at 520. The lower sub-level and the upper sub-level of currents may be empirically determined and stored in tables or functions in controller memory. The tables or functions may be indexed via device parameters such as engine speed and load or other parameters which may be indicative of a forthcoming change in temperature.

Additionally, heater current may be adjusted in response to derivatives of other device parameters such as speed and/or engine load, voltage supplied to the device, and current supplied to the device. For example, if the derivative of engine speed or engine load is positive, heater current may be proportionately increased. Similarly, if the derivative of engine speed or engine load is negative, heater current may be proportionately decreased. In this way, an increase in device temperature may be predicted since increasing engine speed and/or load can increase thermal output of an engine so that heater current adjustments may begin before temperature sensor based heater current adjustments. Likewise, a decrease in device temperature may be predicted since decreasing engine speed and/or load can decrease thermal output of an engine so that heater current adjustments may begin before temperature sensor based heater current adjustments. This may be considered to be a form of feed forward control by those skilled in the art. Method 500 proceeds to exit after heater current adjustments are output.

At 518, method 500 judges whether or not a sign of a derivative is positive. If so, the answer is yes and method 500 proceeds to 520. Otherwise, the answer is no and method 500 proceeds to 522.

At 520, method 500 applies an upper threshold current to a heater supplying thermal energy to control a state of a valve regulating current flow into an engine. In one example, the upper threshold current is a rated current of the heater. In another example, the upper threshold current is a current level below the rated current of the heater. The upper threshold current may be adjusted based on device operating conditions. For example, the upper threshold current may be increased as engine temperature increases. Method 500 proceeds to exit after the upper threshold current is applied to the heater.

At 522, method 500 ceases current flow or reduces is to substantially zero (e.g., less than 300 mA). Current flow to the heater may be reduced or increased via controlling an output of a transistor such as a field effect transistor. Method 500 proceeds to exit after heater current is reduced to substantially zero.

In this way, a controller can swing between upper and lower heater current limits to improve response time of a system that includes a valve that regulates coolant flow from an engine to a radiator. Additionally, by improving system response time, it may be possible to provide more accurate control of engine temperature.

Thus, the method of FIG. 5 provides for adjusting device temperature, comprising: adjusting an amount of electrical current supplied to a heater, the heater in thermal communication with a wax material in a valve, the amount of electrical current adjusted to one of two states, the amount of electrical current adjusted in response to a sign of a derivative of an output of a sole device temperature sensor. In this way, a controller can drive current into or remove current quickly into a heating element that provides thermal energy to a wax medium that controls flow of coolant to a device.

The method includes where the sole device temperature sensor is a cylinder head temperature sensor. The method also includes where one of the two states includes substantially zero current flow. The method also includes where one of the two states includes rated current flow of the heater. The method further comprises increasing current flow through the heater from substantially zero current flow to substantially rated current flow of the heater in response to a positive sign of the device temperature derivative. The method further comprises decreasing current flow through the heater from substantially rated current flow of the heater to substantially zero current flow in response to a negative sign of the derivative.

In another example, the method of FIG. 5 provides for adjusting device temperature, comprising: selecting a desired device temperature range in response to device operating conditions; and adjusting an amount of electrical current supplied to a heater responsive to the desired device temperature range, the heater in thermal communication with a wax material in a valve, the amount of electrical current adjusted to one of two states, the amount of electrical current adjusted in response to a sign of a derivative of an output of a sole device temperature sensor. In this way, heater current can be adjusted to control device temperature within a designate range.

In some examples, the method includes where a first of the two states is substantially zero current, and further comprising adjusting the amount of electrical current to the first state in response to an engine temperature less than a lower threshold of the desired device temperature range. The method also includes where a second of the two states is substantially rated heater current, and further comprising adjusting the amount of electrical current to the second state in response to a device temperature greater than an upper threshold of the desired device temperature range. The method includes where the two states are less than rated heater current.

In one example, the method further comprises adjusting the amount of electrical current in response to engine speed. The method further comprises adjusting the amount of electrical current in response to engine load. Additionally, the method includes where the two states are adjusted in response to operating conditions.

The method of FIG. 5 also provides for adjusting device temperature, comprising: selecting a desired device temperature range and a desired device sub-temperature range, the desired device sub-temperature range within the desired device temperature range, in response to device operating conditions; and adjusting an amount of electrical current supplied to a heater to one of only two states in response to device temperature being in the desired device temperature range and not in the desired device sub-temperature range, and adjusting the amount of electrical current supplied to the heater as a function of a derivative of a sole device temperature in response to device temperature being within the desired device sub-temperature range, the heater being in thermal communication with a wax material controlling flow through a valve.

The method also includes where a first of the only two states is substantially zero current and where a second of the only two states is a rated heater current. The method includes where the amount of electrical current is adjusted proportionately with the derivative of the sole device temperature. The method includes where the desired temperature range varies as device operating conditions vary. The method also includes where a first of the only two states is substantially zero current and where a second of the only two states is less than a rated heater current. The method further comprises adjusting the amount of electrical current in response to engine speed. The method further comprises adjusting the amount of electrical current in response to engine load.

As will be appreciated by one of ordinary skill in the art, the method described in FIG. 5 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, single cylinder, I2, I3, I4, I5, V6, V8, V10, V12 and V16 engines operating on natural gas, gasoline, diesel, or alternative fuel configurations could use the present description to advantage.

The invention claimed is:

1. A method for adjusting temperature of an engine, comprising:

adjusting an amount of electrical current supplied to a heater, the heater in thermal communication with a wax material in a valve coupled in the engine, wherein in response to the engine temperature within a desired engine temperature range, the amount of electrical current is adjusted repeatedly to be at each of a first and a second level, the amount of electrical current adjusted in response to a sign of a time based derivative of an output of a sole engine temperature sensor, in response to an engine stop after and from repeatedly adjusting the amount of electrical current to be at each of the first and the second level, adjusting the amount of electrical current to the first level, in response to an engine restart after and from the engine stop and the engine temperature above the desired engine temperature range, adjusting the amount of electrical current from the first level to the second level, and in response to the engine temperature within a desired engine sub-temperature range and while the engine temperature has reached and remained at a steady value with engine speed at idle speed, the amount of electrical current is adjusted repeatedly to be at each of a third and a fourth level, the third and fourth levels different from and within the first and second levels, wherein the desired engine sub-temperature range is within the desired engine temperature range.

2. The method of claim 1, where the sole engine temperature sensor is a cylinder head temperature sensor, and further comprising maintaining the amount of electrical current at the first level during the engine stop, and maintaining the amount of electrical current at the second level when the engine temperature remains above the desired engine temperature range after the engine restart.

3. The method of claim 1, where the first level includes zero electrical current flow, and the second level includes a rated electrical current flow of the heater.

4. The method of claim 1, further comprising increasing electrical current flow through the heater from zero current flow to a rated current flow of the heater in response to a positive sign of the derivative.

5. The method of claim 1, further comprising decreasing electrical current flow through the heater from a rated current flow of the heater to zero current flow in response to a negative sign of the derivative.

6. A method for adjusting temperature of an engine, comprising:

selecting a desired engine temperature, a desired engine temperature range, and a desired sub-temperature range in response to engine operating conditions, the desired engine temperature within the desired engine temperature range and the desired sub-temperature range, wherein an upper boundary of the desired engine temperature range is above an upper boundary of the desired sub-temperature range, and a lower boundary of the desired engine temperature range is below a lower boundary of the desired sub-temperature range;

adjusting an amount of electrical current supplied to a heater responsive to the desired engine temperature range, the heater in thermal communication with a wax material in a valve coupled in the engine, the amount of electrical current adjusted repeatedly to be at each of a first and a second level, the amount of electrical current adjusted in response to a sign of a derivative of an output of a sole engine temperature sensor;

adjusting the amount of electrical current supplied to the heater to the first level responsive to an engine stop after and from repeatedly adjusting the amount of electrical current to be at each of the first and the second level;

adjusting the amount of electrical current supplied to the heater from the first level to the second level responsive to an engine restart after and from the engine stop and the engine temperature above the upper boundary of the desired engine temperature range; and adjusting the amount of electrical current supplied to the heater repeatedly to be at each of a third and a fourth level responsive to the desired sub-temperature range and while the engine temperature has reached and remained at a steady value with engine speed at idle speed, the third and fourth levels different from and within the first and second levels, the amount of electrical current adjusted in response to a derivative of engine speed.

7. The method of claim 6, where the first level is zero current, and further comprising adjusting the amount of electrical current to the first level in response to the engine temperature less than a lower threshold of the desired engine temperature range, maintaining the amount of electrical current at the first level during the engine stop, and maintaining the amount of electrical current at the second level when the engine temperature remains above the upper boundary of the desired engine temperature range after the engine restart.

8. The method of claim 6, where the second level is a rated heater current, and further comprising adjusting the amount of electrical current to the second level in response to the engine temperature greater than an upper threshold of the desired engine temperature range.

9. The method of claim 6, where the first and second levels are less than a rated heater current.

10. The method of claim 9, further comprising adjusting the amount of electrical current in response to engine speed.

11. The method of claim 9, further comprising adjusting the amount of electrical current in response to engine load.

12. The method of claim 9, where the first and second levels are adjusted in response to operating conditions.

13. A method for adjusting temperature of an engine, comprising:

selecting a desired engine temperature, a desired engine temperature range, and a desired engine sub-temperature range, the desired engine sub-temperature range within the desired engine temperature range, the desired engine temperature within the desired engine sub-temperature range, in response to engine operating conditions;

adjusting an amount of electrical current supplied to a heater repeatedly to be at each of a first and a second level in response to engine temperature being in the desired engine temperature range and not in the desired engine sub-temperature range;

adjusting the amount of electrical current supplied to the heater to the first level responsive to an engine stop after and from adjusting the amount of electrical current repeatedly to be at each of the first and second levels;

adjusting the amount of electrical current supplied to the heater from the first level to the second level responsive to an engine restart after and from the engine stop and the engine temperature above the desired engine temperature range; and adjusting the amount of electrical current supplied to the heater repeatedly to be at each of a third and a fourth level as a function of a derivative of a sole engine temperature sensor output in response to engine temperature being within the desired engine sub-temperature range, the third and fourth levels different from and within the first and second levels, the heater being in thermal communication with a wax material controlling flow through a valve.

14. The method of claim 13, where the first level is zero current and where the second level is a rated heater current, and further comprising maintaining the amount of electrical current at the first level during the engine stop, and maintaining the amount of electrical current at the second level when the engine temperature remains above the desired engine temperature range after the engine restart.

15. The method of claim 13, where the amount of electrical current is adjusted proportionately with the derivative of the sole engine temperature sensor output.

16. The method of claim 13, where the desired engine temperature range varies as the engine operating conditions vary.

17. The method of claim 13, where the first level is zero current and where the second level is less than a rated heater current.

18. The method of claim 13, further comprising adjusting the amount of electrical current in response to engine speed.

19. The method of claim 13, further comprising adjusting the amount of electrical current in response to engine load and/or other parameters that may be indicative of a forthcoming change in the engine temperature.

20. The method of claim 3, where the third and fourth levels are between the first and second levels.

* * * * *